United States Patent [19]

Beers

[11] Patent Number: 4,611,870

[45] Date of Patent: Sep. 16, 1986

[54] MANUALLY OPERATED ELECTRICAL CONNECTOR FOR PRINTED CIRCUIT BOARDS

[75] Inventor: Howard L. Beers, Cape Coral, Fla.

[73] Assignee: Tritec, Inc., Naperville, Ill.

[21] Appl. No.: 639,831

[22] Filed: Aug. 13, 1984

[51] Int. Cl.[4] ..... H01R 9/09

[52] U.S. Cl. ..... 339/75 MP; 339/176 MP

[58] Field of Search ..... 339/17 L, 74 R, 75 MP, 339/91 R, 176 MP

[56] References Cited

U.S. PATENT DOCUMENTS

| | | | |
|---|---|---|---|
| 3,131,985 | 5/1964 | Blonder | 339/37 |
| 3,899,234 | 8/1975 | Yeager et al. | 339/75 MP |
| 3,982,807 | 9/1976 | Anhalt et al. | 339/176 MP |
| 4,298,237 | 11/1981 | Griffith et al. | 339/176 MP |
| 4,403,819 | 9/1983 | Weber | 339/75 MP |

*Primary Examiner*—John McQuade

*Attorney, Agent, or Firm*—Clement and Ryan

[57] ABSTRACT

An electrical connector for printed circuit boards having two or more rows of printed terminals along one edge of the board. When the board is inserted in the connector body, the contacts within the connector are prevented from making contact with any printed terminals on the circuit board until the board has reached its operative position within the connector and all the contacts are aligned with the printed terminals they are intended to make contact with. The contacts within the connector are carried by resiliently deformable supports. The working portion of the connector includes a series of four more elements (one of which is a locking means for automatically preventing operation of the actuator unless a printed circuit board is in place in its operative position within the connector body) each of which is affected by the next succeeding element in a defined way during the operation of the device.

22 Claims, 11 Drawing Figures

FIG. 3
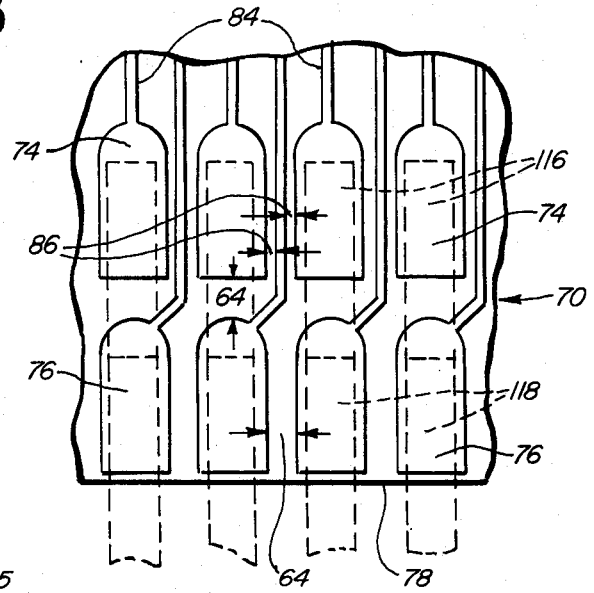
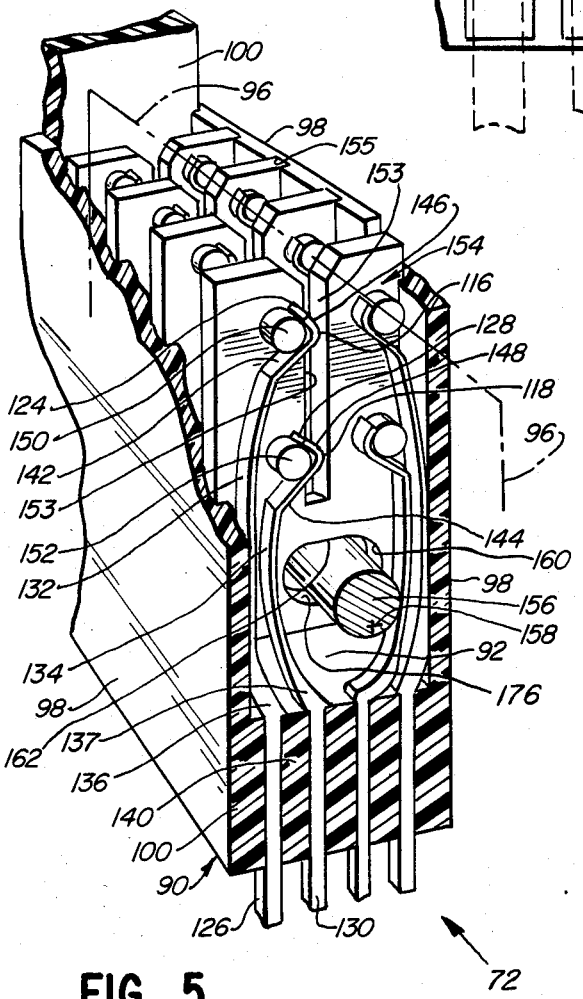
FIG. 5
FIG. 6
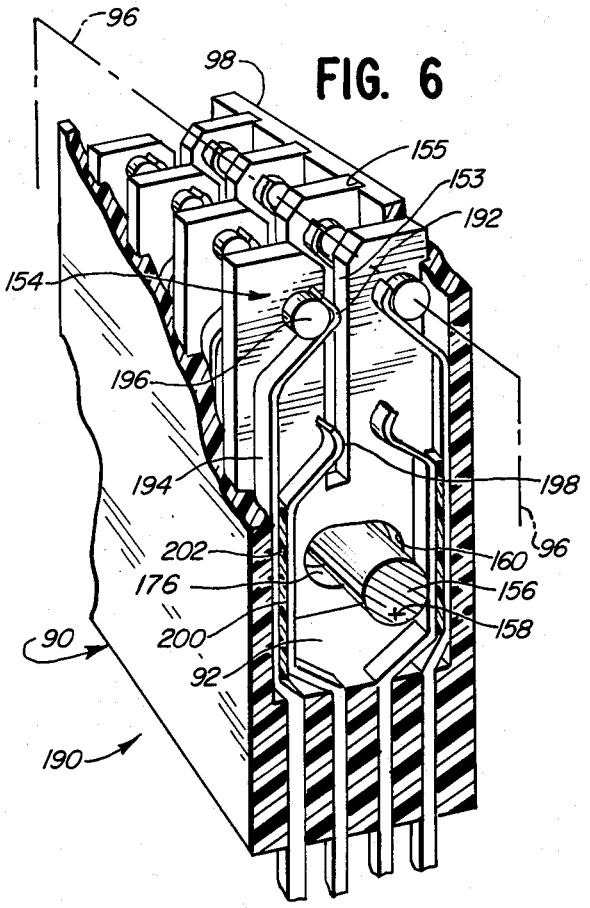

MANUALLY OPERATED ELECTRICAL CONNECTOR FOR PRINTED CIRCUIT BOARDS

This invention relates to an electrical connector for connecting the printed terminals on a printed circuit board with other parts of the electrical system with which the printed circuit board is used, and in particular to such a connector that is manually operated after insertion of the printed circuit board within the connector body.

BACKGROUND OF INVENTION

Transistors and printed circuit boards came into use in various electrical systems nearly simultaneously. They provided a natural combination of components which added greatly to the miniaturization of electronic circuitry.

The connection of the printed circuit board with other parts of the electrical system with which it was used was first accomplished by simply soldering wires on the board and connecting them to a wiring plane or another printed circuit board. Connectors were soon developed which consisted of a connector blade soldered to the printed circuit board, with the blade making contact with another connector blade on a wiring plane or on another printed circuit board. These connectors were arranged as male or female connectors, as the need dictated.

As semiconductor technology advanced, so did the density of the various components contained on a given printed circuit board. Before long, it became apparent that considerable money could be saved if half of the mating connectors could be eliminated, in particular the part that was located on the printed circuit board. Significant strides were made at that time in arranging the printed circuit board to be a male member of a mating contact. These contacts were then arranged along the edge of the printed circuit board, and the board was inserted in the female side of the connector.

The advance of semiconductor technology tended to remove more and more discrete components and place them on integrated circuit chips. The use of such chips led to printed circuit boards of increasing complexity in function. However, as the number of external connections with various components of the printed circuit board increased, there was a limit on the maximum number of such connections that is possible with a connector of a given size.

As a consequence, efforts have been made to increase the "density" of printed terminals on the printed circuit board both by decreasing the width of each terminal and by decreasing the spacing between adjacent terminals. Such efforts are limited by the fact that if the terminals are made too narrow, there is a substantial loss of connector current capacity by reason of the reduced area of contact, and in addition it is difficult to assure proper alignment between the narrower terminals and their associated contacts within the card edge connector. There is also an irreduceable minimum spacing that must be maintained between terminals.

The most recent method of increasing density is to install a separate connector on the printed circuit board in lieu of printed terminals, which doubles the cost with only a slight reduction of insertion force. This expedient amounts to providing two mating connections where there was previously only one.

Various other attempts have been made to increase the number of printed terminals on a printed circuit board that can be accommodated in card edge connectors by changing the structure of the connector itself. However, all attempts of this kind of which applicant is aware have had some shortcoming.

One of these approaches has been to employ stepped terminals on the printed circuit board and correspondingly stepped contacts in the connector, as in Japanese laid-open document No. 58-70688. Such a connector is expensive to make, requires a thicker printed circuit board than is ordinarily used, and does nothing to meet the problem of high insertion and retraction forces that will be discussed below.

Another attempt to increase the density of the printed terminals with which the connector can be used utilizes two rows of printed terminals, with the terminals staggered as one moves alternately along one row and then the other. The contacts in the connector are similarly staggered to match up with the pattern of the terminals. Examples of this type of connector are shown in Japanese laid-open document Nos. 51-162966, 55-8212 and 55-38411. As will be seen from FIG. 3 of the first mentioned document, this approach results in an increase of only a fraction of the total number of terminals that can be accommodated by the connector.

A third approach sometimes doubles the density of the printed terminals on the printed circuit board, but in every case produces another troublesome problem—unwanted and dangerous contacts between unmatched printed terminals on the circuit board and contacts within the card edge connector. Examples of such connectors are disclosed in Japanese laid-open documents Nos. 53-132654, 56-61777, 57-69795 and 58-188995.

In addition to the indicated spacing constraints, conventional electrical connectors of the male/female type have presented another problem. Such card edge connectors presently in use must maintain relatively high contact pressure between the terminals on the printed circuit board and the contacts connected with the output leads of the connector, because they supply the only force holding the connector blades against the printed circuit board. In fact, the pressure that is required to be maintained between the printed terminals of a printed circuit board and the associated contacts within the card edge connector is often so high that the circuit board can not be inserted within the connector simply by being pushed in, but must actually be hammered in by the user of the system.

The pressure between a printed circuit board and the contacts within a card edge connector that causes the board to be inserted into the connector only with extreme difficulty makes it nearly as difficult to extract the board from the connector. This difficulty is further compounded by the fact that generally neither the connector nor the printed circuit board can be grasped conveniently to exert the necessary extraction force, and various tools have had to be developed to assist in applying such force to pry the two members apart.

Zero insertion force and low insertion force connectors are known, but many of them are unnecessarily complicated in structure and none meets the problem of printed terminal density discussed above.

Applicant's invention meets both the problems discussed, by (1) making possible a greatly increased number of printed terminals on the printed circuit board that can be accommodated by this connector, and (2) achieving a secure mode of connection without having to employ the very high contact pressure that is required with conventional connectors.

SUMMARY OF THE INVENTION

The connector of this invention may be used with a printed circuit board that has at least twice the number of printed terminals that is possible with a conventional connector, typically arranged in at least two rows along the leading edge of a circuit board that is inserted within the connector body.

This connector comprises a plurality of specially supported and actuated contacts within a connector body that is formed of insulative material. In use, one edge of a printed circuit board carrying a plurality of printed terminals arranged in two or more rows along that edge can be inserted in the connector body.

Each contact is supported by resiliently deformable support means that normally supports the contact in its open position but can be deformed to press the contact against its associated printed terminal on the printed circuit board. Actuator means is provided for each resiliently deformable support means, as well as means for operating the actuator means. Manually controlled means is provided for urging the operating means to operate the actuator means. And finally, locking means is provided to prevent operation of the actuator means unless a printed circuit board is present in its operative position within the connector.

With this locking means included, no contacts will come into accidental, unwanted contact with any printed terminals on the printed circuit board, and the contacts will come into contact with only those contacts they are intended to contact.

Carriage means, lying entirely outside the predetermined path followed by the printed circuit board within the connector body and preferably located alongside the contacts and their supports, provides one form of means for operating the actuators. The contacts are preferably supported on electrically conductive springs, which in a preferred embodiment have slanting portions against which pins carried by the carriage means are pressed when the carriage means is moved by the manually controlled urging means.

With the electrical connector of this invention, the operating means may operate the respective actuator means for the contacts directly, as for example by means of the carriage already mentioned. Or, if desired, the operating means may operate a given row of actuator means directly, with that operation indirectly resulting, in turn, in the operation of other actuator means for other contacts.

ADVANTAGES OF THE INVENTION

The electrical connector of this invention has the following advantages:

1. Very little force is required to overcome the slight frictional and bending resistances involved when the contacts are pressed into contact with their associated printed terminals.

2. During actuation of the resiliently deformable supports for the contacts, the energy required is largely stored by reason of the resilience of the supports, and this stored energy is thereafter available to assist in ejecting the printed circuit board from the connector.

3. In a preferred embodiment of the connector of this invention, a slight wiping action is provided between each contact and its associated printed terminal on the printed circuit board.

4. The number of terminals that can be accommodated along one side of the printed circuit board can be increased by a factor of two or even more. In other words, the "density" of the printed terminals on the printed circuit board, and their respective contacts in the connector means, can be very significantly increased.

5. Although the density of the printed terminals is increased by using two parallel rows of terminals along one edge of the printed circuit board and when that edge of the board is inserted in the connector body one of the rows of terminals must move past a row of contacts which it is not intended to contact before it reaches the row it is intended to make contact with, in the connector of this invention no accidental contact is permitted between the contacts and any printed terminals on the board. No contact at all is permitted until the board has safely reached its operative position within the connector and all the contacts are aligned with the printed terminals that they are intended to make contact with.

6. With the electrical connector of this invention, it is possible to arrange the terminals on a printed circuit board at the top or bottom of the board, or both. Because of this fact, no special card guides or tracks are required, and the heat producing elements of the electronic system can be positioned in a unique and advantageous manner.

BRIEF DESCRIPTION OF THE DRAWINGS

The invention will be described in connection with the accompanying drawings, in which:

FIG. 3 is a plan view of a portion of a printed circuit board, with two rows of printed terminals adjacent one edge of the board, which may be used with one embodiment of the electrical connector of this invention;

FIG. 5 is a broken-away perspective view of the electrical connector of FIG. 4 showing a section taken along the line 5—5 in that Figure, with the actuator means for all contacts in the connector directly operated;

FIG. 6 is a similar view of another embodiment of the connector of this invention, in which the actuator means for the first row of contacts is directly operated and the actuator means for the second row of contacts is indirectly operated;

Typical Printed Circuit Board And Connector In Current Use

Figure 1:
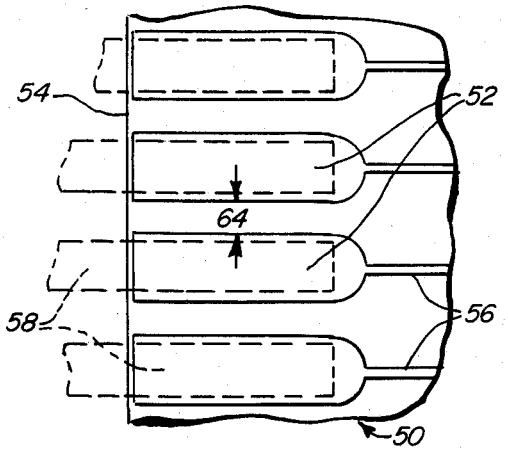
FIG. 1 PRIOR ART
FIG. 1 is a plan view of a portion of a conventional printed circuit board with a single row of printed terminals adjacent one edge of the board, showing in dashed outline the connector blade within the connector body that overlies each printed terminal.
Figure 2:
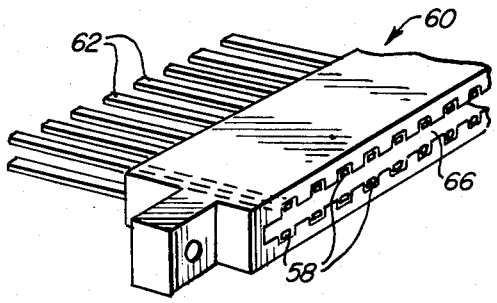
FIG. 2 PRIOR ART
FIG. 2 is a reduced, fragmentary, perspective view of a conventional card edge connector for use with the printed circuit board shown in FIG. 1.

FIG. 1 is a plan view of a portion of a typical printed circuit board in current use, and FIG. 2 is a fragmentary perspective view of a card edge connector in common use with such circuit boards.

Printed circuit board 50 has one row of printed terminals 52 disposed along first edge 54 of the board. Terminals 52 are connected by leads 56 to various portions of the circuitry contained on the printed circuit board.

Contacts 58, contained in card edge connector 60 (shown in reduced size in FIG. 2), make contact with terminals 52 when printed circuit board 50 is inserted in connector 60. Output leads 62 carried by connector 60 are used to connect printed terminals 52 with other parts of the electrical system with which the printed circuit board is used.

The maximum number of printed terminals 52 that can be positioned along edge 54 of printed circuit board 50 is limited by the minimum acceptable width of the terminals and the minimum spacing 64 that is acceptable between immediately adjacent printed terminals.

In addition, as is apparent from FIG. 2, when leading edge 54 of circuit board 50 is pushed into space 66 between opposed rows of contacts 58 within card edge connector 60, considerable force will be required because of the high level of pressure that must be provided between contacts 58 and terminals 52 to assure a secure electrical connection. Nearly the same force will be required to remove the printed circuit board from the connector.

Both these problems are overcome by the connector of the present invention.

Figure 4:
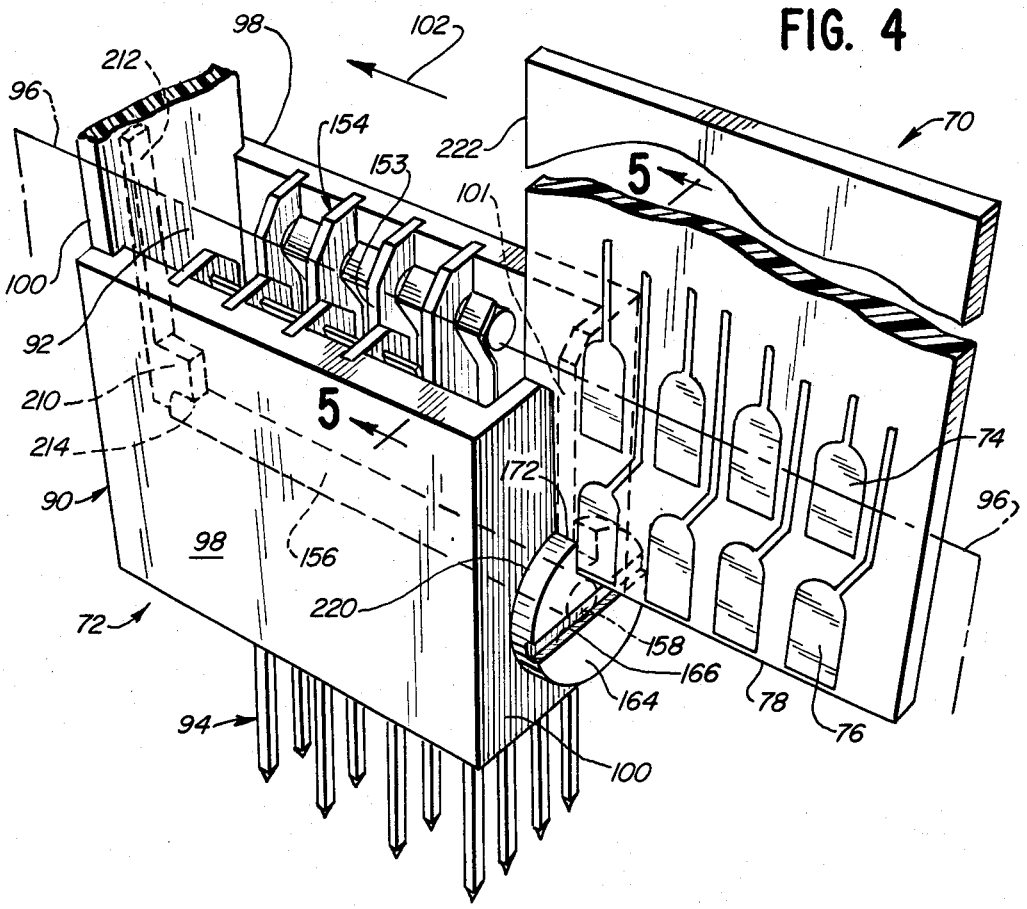
FIG. 4 is a schematic perspective view of one embodiment of the electrical connector of the present invention with the printed circuit board of FIG. 3 just being inserted within the connector body, with portions of the printed circuit board and connector body broken away for clarity, and with two rows of printed terminals visible on the near side of the printed circuit board, each row being limited to four terminals for illustrative purposes only.

Circuit Board Having Two Rows Of Terminals For Use With One Embodiment Of This Invention FIG. 3 is a fragmentary plan view of a printed circuit board 70 that can be used with the embodiment of this invention shown as connector 72 in FIG. 4.

In FIG. 3, a first row of printed terminals 74 and a second row of terminals 76 are arranged in a predetermined pattern parallel to first edge 78 of circuit board 70. First row of terminals 74 lies farther than second row of terminals 76 from board edge 78. (A printed terminal in the first row is sometimes referred to below as a "first printed terminal," and a terminal in the second row is sometimes referred to as a "second printed terminal.")

The printed terminals of printed circuit board 70, like those of board 50 in FIG. 1, are spaced from each other laterally by the minimum acceptable distance 64. In addition, they are spaced from each other by the minimum distance 64 longitudinally as well. Moreover, each lead 84 that is connected with a printed terminal 76 is spaced by an acceptable minimum distance 86 from each terminal 74 past which the lead runs to its respective component of the circuitry on printed circuit board 70.

Comparing printed circuit boards 50 and 70 in FIGS. 1 and 3 shows that the latter provides a density of printed terminals (in rows 74 and 76) at first board edge 78 that is double the density of the printed terminals along edge 54 of board 50 (in single row 52). This doubling of the density of printed terminals is accomplished with the terminals maintained at the same width as the terminals in conventional printed circuit board 50, and with the terminals and their leads maintained at the necessary minimum distances from each other.

General Construction Of Connector

The general construction of the electrical connector of this invention will first be described, followed by a description of the particular arrangements of parts in two different connectors. In this specification the same designator numerals are employed for the same parts in each embodiment described.

Connector Body

In FIG. 4, which gives a schematic illustration of one embodiment of the electrical connector of this invention, connector body 90 of electrical connector 72 is a narrow, hollow body formed of rigid, insulative material. In an actual embodiment of the electrical connector of this invention, connector body 90 is much longer and accommodates rows having many more contacts than in the schematic showing of FIG. 4. Connector body 90 is provided with means (not shown) for attaching it to the cage in which printed circuit board 70 is to be used. Output leads 94 are fixedly attached to the connector body and extend outward therefrom.

Connector body 90 has a median plane 96 through its vertical center in FIG. 4. Main walls 98 are parallel to the median plane, and are connected by narrow walls 100. Walls 98 and 100 together define interior 92 of the connector body, and define an opening 101 (on the near side of connector body 90 in FIG. 4) for receiving printed circuit board 70 in the manner to be described below.

When circuit board 70 is inserted by the user of the connector of this invention in the board-receiving opening just mentioned, the board is guided through predetermined path 102 generally parallel to first edge 78 of printed circuit board 70, into an operative position (shown in FIGS. 7–10) within the interior of connector body 90. In that operative position, board 70 is disposed generally parallel to main walls 98 of the connector body.

Contacts

FIG. 5 is a broken-away perspective view of the embodiment of the electrical connector of this invention illustrated in FIG. 4, viewed from the right in that Figure, with a section taken alorg line 5—5.

Connector body 90 houses various elements of the connector in interior 92 that is defined by main walls 98 and narrow walls 100 (one of which is seen at the left-hand side of FIG. 5).

The first row of contacts 116 and second row of contacts 118 are contained within connector body interior 92. First row of contacts 116 is positioned farther from first edge 78 of printed circuit board 70 when the board is in its operative position in connector body 90 than is second row of contacts 118. Contacts 116 and 118 are arranged in a pattern that is the mirror image of the predetermined pattern of printed terminals 74 and 76, respectively, of printed circuit board 70.

The connector of this invention is constructed so that contacts 116 and 118 just described make contact only with their mirror image of printed terminals, and with no other terminals on the printed circuit board. In other words, the first row of contacts can make contact only with the first row of printed terminals, and the second row of contacts only with the second row of printed terminals.

First contacts 116 and second contacts 118 are shown in dashed outline in FIG. 3. As will be seen, contacts 116 and 118 overlie printed terminals 74 and 76, respectively, of printed circuit board 70 when the board has been inserted in connector 72 and has been moved to its operative position.

As is seen from FIG. 5, each contact 116 has a free end 124 that is associated with a printed terminal 74 of printed circuit board 70 and is electrically connected with output lead 126. Similarly, each second contact 118 has a free end 128 associated with printed terminal 76 and electrically connected with output lead 130.

To increase the available contact area, contacts 116 and 118 are rounded and preferably bifurcated.

In FIG. 5, contacts 116 and 118 are shown in their open positions, as will be explained below. Contacts 116 and 118 also have closed positions for contact with their associated printed terminals, which are likewise explained below.

Supports For Contacts

As further seen from FIG. 5, first contact 116 is supported by resiliently deformable support 132, which normally supports the contact in its open position. Likewise, second contact 118 is carried by resiliently deformable support 134 and is normally supported by that member in its open position. In their normal open positions, contacts 116 and 118 are spaced from the plane in which the top surfaces of printed terminals 74 and 76 lie, when printed circuit board 70 is inserted in connector 72, by a gap that will be described below and indicated in FIG. 7.

Contact 116 is preferably integrally formed, as shown in FIG. 5, with its resiliently deformable support means 132. In the embodiment shown, support 132 has the form of an elongated, electrically conductive flat spring member fabricated from a suitable metal such as a phosphor-bronze alloy. Contact 118 is similarly integrally formed with its support 134.

In connector 72, supports 132 and 134 have rectangular cross-sections. The supports may be formed of any other suitable cross-section, as desired, such as for example a round spring wire.

Base portion 136 of support 132 is anchored to connector body 90 with the other end of the support carrying its associated contact 116. Base portion 137 of support 134 is similarly anchored to connector body 90, with the other end of the support carrying contact 118. In the embodiment shown, base portion 136 and 137 of supports 132 and 134, respectively, are arranged one upon the other in a stack normal to median plane 96 of connector body 90, with the two base portions of the supports being separated by electrically insulative material 140.

Support 132 thus provides an electrical connection between contact 116 and individual output lead 126, and support 134 connects contact 118 with individual output lead 130. At the same time, the supports in one row are insulated, together with their associated contacts, from the other row of contacts and their supports.

In the embodiment shown, support 132 for a given contact in the first row overlies a support 134 in the second row of contacts. Other arrangements of the two rows of supports may be used, if desired, so long as they remain insulated from each other.

A first portion 142 of elongated, flat spring member 132 slants diagonally with respect to median plane 96, with the end of portion 142 that is farther from base portion 136 of member 132 being closer to the median plane than is the other end. In the same way, first slanting portion 144 of elongated flat spring support 134 slants diagonally with respect to median plane 96, and the end of portion 144 that is farther from base portion 137 of member 134 is closer to median plane 96 than is the other end.

A second portion 146 of elongated spring support 132 slants diagonally with respect to median plane 96, with the end of portion 146 that is farther from base portion 136 of member 132 being farther from that plane. In the same way, second portion 148 of elongated spring member 134 slants diagonally with respect to median plane 96, with the end of portion 148 that is farther from base portion 137 of member 134 being farther from the plane. In the embodiment of FIG. 5, second slanting portions 146 and 148 are located at the free ends of spring members 132 and 134, respectively.

The purpose of slanting portions 142,144 and slanting portions 146,148 will be explained below.

If desired, other forms of support means, including a number of variants disclosed in my copending application Ser. No. 639,832, filed Aug. 13, 1984, entitled "Board-Operated Electrical Connectors For Printed Circuit Boards," may be employed in the connector of this invention.

The elements discussed so far are present in the electrical connector of this invention whether the members within the connector are all directly actuated, or whether some are directly actuated while others are indirectly actuated. The different structures of the electrical connector of these two types will now be described.

Direct Operation Of All Actuators Of The Connector

The Actuators

In the embodiment of the connector of this invention illustrated in FIG. 5, actuator 150 for support 132 and actuator 152 for support 134 are both rigid pins formed of insulative material extending perpendicularly from carriage 154 in a direction transverse to their respective elongated supports. Pin 150 normally nests within, and contacts, slanting portions 142 and 146 (which are described above) of support 132 for first contact 116. Pin 152 bears the same relation to slanting portions 144 and 148 of support 134 for second contact 118.

In view of their described relationships to elongated supports 132 and 134, respectively, pins 150 and 152 are in a position to move (downward in FIG. 5) against slanting portions 142 and 141 to urge the respective support means with which they are associated in a direction generally normal to median plane 96 and thereby move contacts 116 and 118, respectively, into their closed positions.

Movable Carriage As Operating Means

In addition to the other elements already described, the electrical connector of this invention includes means for operating the actuators such as actuator pins 150 and 152, which as just explained are positioned to bend supports 132 and 134, together with the contacts they support, to the right in FIG. 5 toward their associated printed terminals on printed circuit board 70.

In the embodiment shown in FIG. 5, the operating means is comprised of movable carriage 154 supporting both the actuator pins. Carriage 154 lies entirely outside the predetermined path 102 (FIG. 4) that is followed by printed circuit board 70 as it is inserted into the connector body and through elongated slot 153 in the carriage, and is moved to its position indicated in FIG. 7. In this embodiment, carriage 154 is positioned alongside elongated support means 132 and 134.

In FIG. 5, carriage 154 is slidably mounted in groove 155 in the inner surface of at least one main wall 98 of connector body 90.

Actuator pins 150 and 152 extend from one side only of movable carriage 154 in the embodiment of FIG. 5. If desired, the number of carriages 154 may be reduced by omitting every second carriage and mounting actuator pins on both sides of each remaining carriage, or even by omitting still more carriages and extending the length of each actuator pin to overlie several flat spring supports 132 or 134, as the case may be. In the latter case, the extended actuator pin can be secured at both ends to a movable carriage.

Manually Controlled Means For Urging Operating Means

In FIG. 5, manually controlled means for urging carriage means 154 to operate actuator pins 150 and 152 has the form of elongated cam means 156. Cam 156 is rotatably attached to the connector body, and rotates about its offset axis of rotation 158.

Carriage 154 has opening 160 in its end opposite the end on which actuator pins 150 and 152 are mounted. Rotatable cam 156 has a curvilinear outer surface, and is positioned within opening 160 to press against wall 162 of the opening when it is in the position shown in FIG. 5. In this position, cam 156 holds carriage 154 in the highest position it assumes within the connector body as it moves up and down therein. This may be called the open, inoperative position of cam 156, since in this position carriage 154 is not being urged by the cam to operate actuator pins 150 and 152. Carriage 154 is held within connector body 90 when no printed circuit board is present in the connector body by cam 156, which is positioned to contact lower wall or retaining abutment 176 of the carriage means.

As seen in FIG. 4, in the embodiment shown cam 156 may be rotated about axis 158 by turning disk-like stop member 164 which is fixedly secured to the cam perpendicular to axis of rotation 158 of the cam. Groove 166 may be engaged, for example, by a screwdriver to turn disk-like member 164.

It will be apparent to those skilled in the art that other manually controlled means may be employed to urge operating means(such as carriage 154)to operate the actuators for the contacts of the connector of this invention. For example, with appropriate modification of the structure of this connector, other means such as sliding cams, levers, solenoid actuation, or the like may be incorporated in the connector.

Operation Of Actuators And Supports In Embodiment Of FIG. 5

The operation of actuator pins 150 and 152 can be seen from FIGS. 5 and 7–9.

Figure 7:
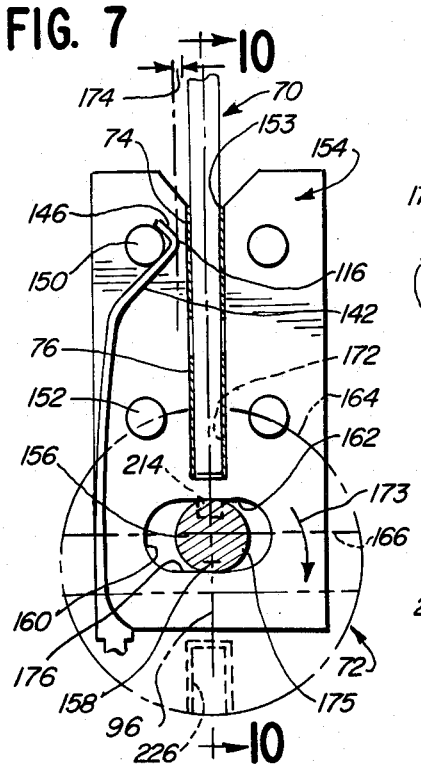
FIG. 7 is a side elevation taken from the right of the working parts of the electrical connector of FIG. 5 (with the connector body omitted for clarity) just after the printed circuit board has been inserted in the connector body and moved to its operative position therein.

In FIG. 7, printed circuit board 70 has been pushed perpendicularly into the plane of the paper through board-receiving opening 101 of the connector body (which latter member is omitted for clarity), and has been moved into its fully operative position within the connector body. Board 70 has also passed through slot 172 located at a predetermined angular position in the outer peripheral portion of disk-like rotatable stop member 164 (shown in phantom in this Figure).

Disk-like stop member 164 is disposed perpendicularly to axis of rotation 158 of rotatable cam 156. In this Figure, the cam is shown in its open inoperative position (as in FIG. 5) with its curvilinear external surface pressing against wall 162 of opening 160 in carriage 154. As has been pointed out above, with cam 156 in this position, carriage 154 is in the highest position it assumes within connector body 90.

Spring support 132 for contact 116, including first slanting portion 142 and second slanting portion 146, is shown in FIG. 7 to illustrate the operation of this embodiment of the connector of the present invention. With carriage 154 in the position shown in this Figure, actuator 150 is not pressing against first slanting portion 142 of the support means and contact 116 is therefore spaced from printed terminal 74 on printed circuit board 70 by gap 174. At this juncture, the other contacts of electrical connector 72 are similarly spaced from their associated printed terminals on circuit board 70. (The other spring support on the left-hand side of FIG. 7 (spring support 134), and the two corresponding spring supports on the right-hand side of FIG. 7, are omitted for clarity.)

Figure 8:
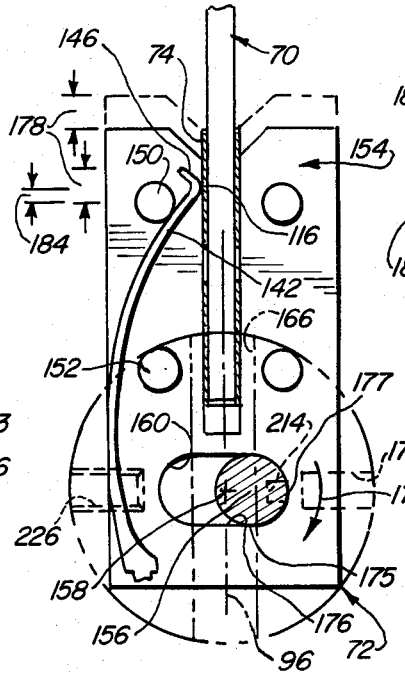
FIG. 8 is a similar view of the working parts of the electrical connector of FIG. 5 after it has been partially operated.

In FIG. 8, rotation of cam 156 90° in clockwise direction 173 about its off-center axis of rotation 158 has brought portion 175 of the curvilinear external surface of the cam (which is on the right in FIG. 7) to bear against lower wall 176 of opening 160 in carriage 154. This has moved carriage 154 downward by distance 178 from the position it occupied in FIG. 7. This movement of carriage 154 carries actuator pin 150 downward by the same distance.

As pin 150 moves downward, it slides longitudinally along first slanting portion 142 of resiliently deformable support means 132, and presses the support and its associated contact 116 to the right in FIG. 8. At this point, contact 116 has been pressed into initial contact with its associated printed terminal 74 of printed circuit board 70.

Figure 9:
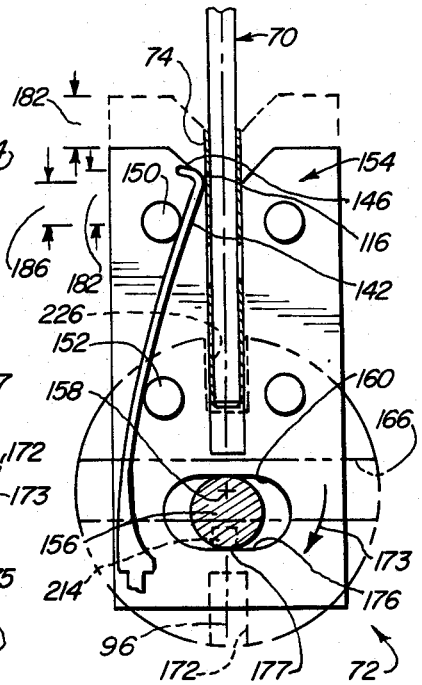
FIG. 9 is a similar view showing the working parts of the electrical connection of FIG. 5 after it has been fully operated.

When cam 156 is rotated in clockwise direction (as seen in FIG. 9) an additional 90° about its off-center axis of rotation 158, portion 177 of its curvilinear external surface (which is on the right in FIG. 8) has been brought to bear against bottom wall 176 of opening 160 in carriage 154. At this point, cam 156 has pushed carriage 154 downward from the position occupied by the carriage in FIG. 7 by a distance 182.

Actuator pin 150 has been carried by carriage 154 downward the same distance 182. The actuator pin has thereby moved farther along longitudinally on first slanting portion 142 of deformable support means 132, and has pressed contact 116 into full pressure contact with printed terminal 74 of printed circuit board 70.

In the position shown in FIG. 9, cam 156 occupies what may be called its closed, operative position. In this position, all the contacts within electrical connector 104 are in full pressure contact with their associated terminals of the printed circuit board.

When the printed circuit board is to be removed from connector 72, cam 156 is rotated 180° either clockwise or counterclockwise to return carriage 154 and the actuator pins carried by it to the positions they originally occupied as shown in FIG. 7. In this position, contact 116 and the other contacts of the connector are again spaced from their associated printed terminals on the circuit board by gap 174. As a consequence, when the printed circuit board is slid out of the connector body and through elongated slot 153 in carriage 154, there will be no accidental, harmful contact between any of the contacts of connector 72 and the printed terminals on the circuit board.

Five Elements In Working Portion Of Connector

To sum up, the working portion of the device of this invention includes a series of five elements—(1) resiliently deformable support means for each contact, (2) actuator means to push each support towards its associated printed terminal on the printed circuit board, (3) means to operate the actuator means, (4) manually controlled means for urging the last named means to operate the actuator means, and (5) locking means for preventing operation of the actuator means unless a printed circuit board is in place in its operative position within the connector body—each of which is affected by the next succeeding element in a defined way during the operation of the device.

Resiliently deformable supports 132 and 134, actuator pins 150 and 152, carriage 154, and cam 156, respectively, are examples of the first four elements referred to. The fifth element, the defined locking means, will be described in a later section of this specification.

Two Of The Advantages Of The Connector Of This Invention

This description of the operation of the embodiment of FIG. 5 as shown in FIGS. 7–9 in successive stages of its operation emphasizes that among other advantages the electrical connector of this invention has the following two very important advantages, which have already been referred to above:

1. Printed circuit board 70 is inserted in connector 72 with zero insertion force, and the only forces that need thereafter to be overcome when contacts 116 and 118 are brought into contact with their associated printed terminals 74 and 76 on printed circuit board 70 are very small indeed.

These forces include (a) the slight frictional force to be overcome as actuator pins 150 and 152 slide along first slanting portions 142 and 144 of their associated elongated flat spring supports 132 and 134, respectively, (b) the resistance of the elongated supports to bending toward the printed circuit board, and (c) the frictional force between the contacts and printed terminals 74 and 76 as the contacts slide along the terminals. Obviously the sum of all these forces is quite small.

2. As first contact 116, for example, makes initial contact with printed terminal 74 of printed circuit board 70 and then slides along the printed terminal as its deformable support 132 is further flattened out against the terminal, a small but effective wiping action takes place. The wiping action is sufficient to scrape through any layer of oxide that may have formed on either contact 116 or printed terminal 74.

In FIG. 8, contact 116 has moved a distance 184 upward from the position it occupied in FIG. 7 in relation to pin 150, and as it makes initial contact with printed terminal 74 during the last part of that movement it has scraped against terminal 74. Between FIGS. 8 and 9, contact 116 moves to a point located distance 186 from its position in FIG. 7 relative to pin 150, and it scrapes contact 74 throughout that movement.

Function Of Slanting Portions Of Supports

The operation of embodiment 72 of the electrical connector of this invention just described by reference to FIGS. 5 and 7–9 makes clear the function performed by first slanting portions 142 and 144 of elongated, flat spring supports 132 and 134, respectively.

First slanting portion 142, for example, has two functions:

When actuator pin 150 pushes (downward in FIG. 7) against the inclined plane provided by first slanting portion 142, the actuator applies a force normal to that plane that has a component directed (to the right in FIGS. 7–9) toward median plane 138 of connector body 106. Since support 132 is deformable, this force bends member 132 and moves first contact 116 carried by that member in the same direction, to bring the contact into contact with its associated printed terminal 74.

When printed circuit board 70 is removed from connector 72 (as will be described below), the force directed to the left in FIGS. 7 and 8 that is one component of the force exerted by deformed resilient spring 132 as it returns to its normal shape assures that contact 116 will be moved back up to its normal open position, so that it will not make any contact with any printed terminals, but will remain spaced from all terminals, while the printed circuit board is removed from connector 72.

Second slanting portion 146 of support 132, for example, has the following function:

Second slanting portion 146 cooperates with first slanting portion 142 to form a V-shaped member in which actuator pin 150 nests when carriage 154 is in its uppermost position as shown in FIG. 7. This V-shaped nesting arrangement assists in holding carriage 154 in the position described, and allows for more play between rotatable cam 156 and upper wall 162 of opening 160 in the carriage. This in turn means that the latter two members—cam 156 and wall 162—do not need to be held to such close tolerances during manufacture of the connector of this invention.

Indirect Operation Of Some Actuators

In the embodiment of this invention so far discussed, the operating means, such as a movable carriage, operates the actuators for all the contacts of the connector directly. In other embodiments of the connector of this invention, if desired the operating means operates a given one of the actuators directly and the operation of that given actuator results indirectly in the operation of the other actuator or actuators.

Movable Carriage As Operating Means

FIG. 6 is a broken-away perspective view of such an embodiment 190 of the connector of this invention.

In this embodiment, each contact 192 in the first row of contacts is integrally formed with elongated, flat spring support 194 and has associated with it actuator pin 196. Each contact 198 in the second row of contacts is integrally formed with elongated flat spring support 200, in a manner similar to the construction of electrical connector 72 already described, but has no actuator associated with it in the form of a pin mounted on a movable carriage.

In connector 190, the actuator means for flat spring support 200 for second contact 198 is layer 202 of insulative material that is positioned between and in contact with the base portions of support 194 for first contact 192 and support 200 for the second contact.

As will be seen from FIG. 6, actuator pin 196 for first contact 192 is located within interior 92 of connector body 90 in a position exposed to the application of translational force by carriage 154 when that member is urged downward by rotation of cam 156 as described above in connection with FIGS. 5 and 7–9.

Elongated flat spring supports 194 and 200 are disposed and arranged so that movement of support 194 in a direction normal to median plane 96 of connector body 90 causes movement of support 200 in a similar direction. When translational force is applied to actuator pin 196 in the downward direction in FIG. 6, that actuator presses against support 194 to move it and contact 192 supported by it in a direction generally normal to median plane 96 into initial contact with its associated printed terminal on the printed circuit board that has been inserted in connector body 90.

At the same time, through the described movement of support 194, pin 196 causes actuator/insulator 202, in turn, to press in a direction generally normal to median plane 96 against support 200, to bring second contact 198 also into initial contact with its associated printed terminal. Actuator pin 196 is thus operated directly, while actuator 200 is operated indirectly.

In this embodiment, flat spring support 194 for contact 192 is spaced farther from median plane 96 than is flat spring support 200 for second contact 198. It also is located in a position adjacent to and overlying support 200.

If desired, second contact 198 may have an actuator that is directly operated and the actuator for first contact 192 may be indirectly actuated. In such case, second contact 198 may have an actuator pin that is exposed to application of translational force by carriage 154, so that it is support means 200 for second contact 198 that is directly pressed toward median plane 96. In such case, longer resiliently deformable support 194 can be pulled toward median plane 96 by an insulative connector (such as a rivet or stud formed of insulative material) between lower spring member 200 and upper spring member 194.

Locking Means

FIGS. 4, 7, 10 and 11 illustrate one form of locking means for preventing operation of actuator means such as pin 150 until after printed circuit board 70 has been inserted in the connector body and moved to its operative position in that body. This is essential in order to avoid accidental pressing of contacts such as 116 against the contacts on the opposite side of the connector body.

Figure 10:
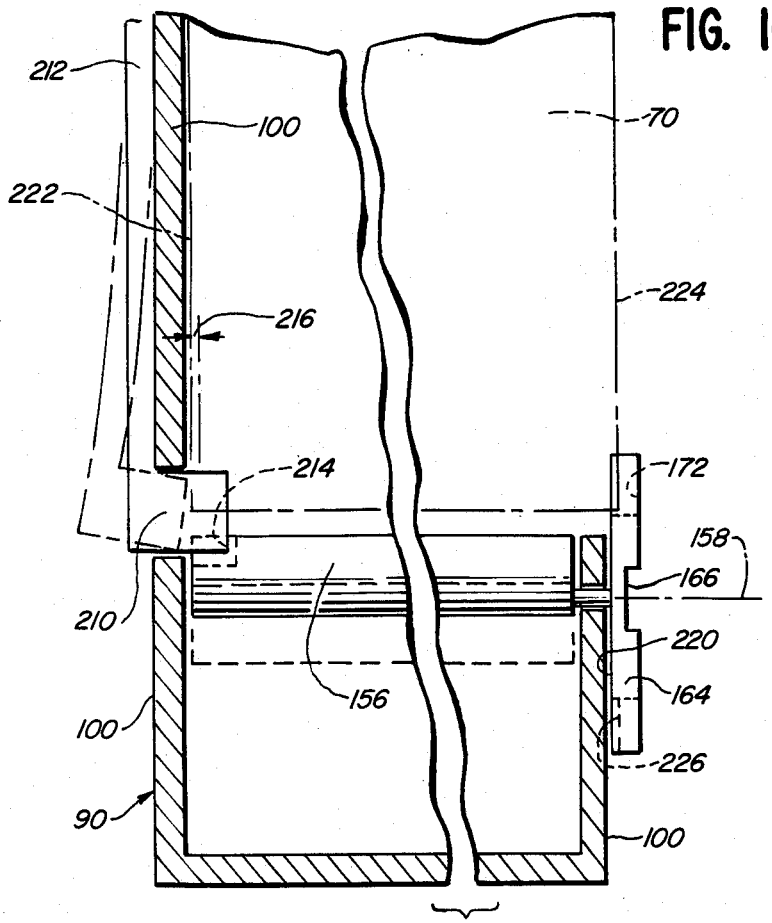
FIG. 10 is a side elevation taken from the left in FIG. 4 (with the connector body added), showing the rotatable disk-shaped stop member, rotatable cam means fixedly secured thereto, and locking means in the form of a resiliently deformable pawl means, of the electrical connector of FIG. 4.

FIG. 10 is a sectional view (partly broken away through line 10—10 in FIG. 7, with connector body 90 added. Elongated, resiliently deformable pawl means 210 is securedat its base portion 212 to narrow wall 100 of connector body 90. Pawl means 210 is normally positioned in positive engagement with an opening in the form of notch 214 at the end of rotatable cam 156. The pawl means is removable from notch 214 only after printed circuit board 70 has been inserted within connector body 90 and moved—while all the contacts in the connector are held by their respective supports in their normal open positions—along its predetermined path all the way to its operative position as shown in phantom in FIG. 10.

With printed circuit board 70 in this position, pawl 210 is pushed out of engagement with notch 214, where it remains so long as the printed circuit board remains fully inserted in the connector. With the pawl means disengaged from notch 214, it is seen that rotatable cam 156 can be rotated freely to urge the carriage means to operate the actuators, which then press their associated support means and contacts supported thereby into contact with their associated printed terminals on the printed circuit board.

Figure 11:
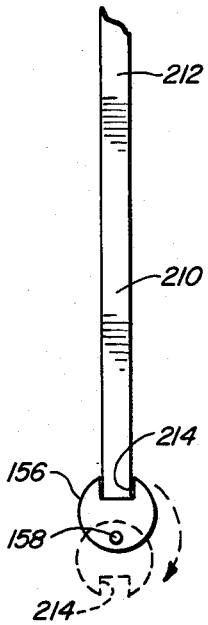
FIG. 11 is an end elevation from the left in FIG. 10 showing the rotatable cam means and locking means of the embodiment of FIG. 10. cl DETAILED DESCRIPTION OF SPECIFIC EMBODIMENTS OF THE INVENTION The connector of this invention will now be described, by reference to the accompanying drawings, in relation to specific embodiments of the invention.

FIG. 11 is an end elevation from the left in FIG. 10 showing rotatable cam means with its offcenter axis of rotation 158, and elongated deformable pawl means 210. (End wall 100 of connector body 90 is omitted for clarity.) Pawl 210 is shown in engagement with notch 214 when cam 156 is in the position shown in full lines in FIGS. 10 and 11. When the pawl is disengaged from notch 214 by insertion of printed circuit board 70 in connector body 90 as explained above, cam 156 is free to rotate 180° into the position shown in phantom in FIGS. 10 and 11.

If desired, printed circuit board 70 may be inserted in connector body 90 from above the connector body (positioned as seen, for example, in FIG. 4) rather than through board-receiving opening 101 in end wall 100. If this is the case, resiliently deformable pawl means 210 may be provided with a camming surface facing edge 222 of circuit board 70, so that as the circuit board is lowered into connector body 90, the board will act as a cam to push pawl 210 out of its normal engagement with notch 214 in cam 156 so that the latter cam can be rotated as just described.

Holding Of Printed Circuit Board In Connector Body By Stop Member

A further safety factor is provided by the fact that, as seen in FIG. 10, stop member 164 holds printed circuit board 70 securely in its operative position within the connector body whenever the carriage means and actuator pins carried by it are being urged into positions where they cause contact 116 and the other contacts of the electrical connector to make contact with their associated printed terminals on printed circuit board 70. The presence of the circuit board prohibits any accidental contact between contacts on one side of the connector with the contacts facing them (such as are seen in FIGS. 5 and 6) on the other side of the connector.

As seen from FIGS. 4 and 7–9, when slot 172 in the peripheral portion of rotatable stop member 164 moves to any extent from the 12 o'clock position shown in FIGS. 4 and 7, the stop member will block any movement of the printed circuit board out of its fully inserted position within connector body 90. As slot 172 rotates clockwise in those Figures to bring rotatable cam 156 to bear against carriage 154 and thereby move actuator pin 150 and the other similar pins in the connector, the printed circuit board is held firmly in its fully operative position by the blocking action of stop member 164.

It is only after stop member 164 has been rotated back to its original position, in which slot 172 is again in the 12 o'clock position, that the printed circuit board can be slid out of the connector body. At this point, as shown in FIG. 10, pawl means 210 takes over the safety function again by re-engaging notch 214 of cam means 156 to prevent any downward movement of carriage 154 that might bring about the making of unwanted contacts within the connector.

It will be seen that any undesired downward movement of carriage 154 to press actuator pin 150 and the other actuators against the deformable supports will be avoided by one of two actions of the embodiment of the connector of this invention disclosed in the drawings. Such undesired downward movement of carriage 154 will be avoided at all times either (1) by the presence of printed circuit board 70 moving in or out of the connector through slot 172 of rotatable stop member 164, or (2) by engagement of pawl 210 in notch 214 on cam 156 as soon as printed circuit board 70 has been moved by any substantial distance (such as a distance greater than the distance designated as 216) to the right in FIG. 10.

Detent Function Of Stop Member

Rotatable stop memmber 164 provides an additional feature to insure secure retention of printed circuit board 70 within the connector body.

As seen in FIGS. 4 and 10, stop member 164 has planar surface 220 adjacent board-receiving opening 101 of connector body 90. In FIGS. 7–9, planar surface 220 is on the far side of stop member 164, which member is shown in phantom in those Figures. In FIG. 10, planar surface 220 of member 164 faces to the left.

As seen in FIG. 10, operation-preventing pawl 210 is normally biased against leading edge 222 of printed circuit board 70 after the board has been inserted in the connector body and moved to its operative position. Pawl 214 thus urges trailing edge 224 of board 70 against planar surface 220 of rotatable stop member 164 whenever that member has been rotated from its open position (such as seen in FIG. 7) any substantial angular distance towards its closed position (such as seen in FIG. 9).

Planar surface 220 defines groove 226 located in an angular position on that surface that is different from the angular position of slot 172 on stop member 164. When stop member 164 has been rotated all the way to its closed position, pawl 210 urges trailing edge 224 of the printed circuit board in a resilient fashion into groove 226. As a result, groove 226 performs a detent function to keep stop member 164 in place with slot 172 located 180° away from the position in which it will permit printed circuit board 70 to move out of the connector body. This provides some measure of additional security in keeping the printed circuit board safely within the connector body.

The detent function that results from movement of printed circuit board 70 into groove 226 on stop member 164 as just described has an advantageous by-product in the form of a slight, but useful, wiping action.

By the time stop member 164 has been rotated 180° into its closed position so that groove 226 is aligned with printed circuit board 70, all contacts 116 and 118 have been brought into full pressure contact with their associated printed terminals 74 and 76, respectively. Hence, when board 70 is urged by pawl 214 through the short distance required for the board to drop into groove 226, all the contacts will produce a small wiping action against their associated printed terminals. Although the wiping action is slight, it will produce an appreciable and helpful scraping through any oxide film that may be present on either the contacts or their associated printed terminals on the circuit board.

The above detailed description has been given for ease of understanding only. No unnecessary limitations should be understood therefrom, as modifications will be obvious to those skilled in the art.

I claim:

1. A manually operated connector for connecting a plurality of spaced printed terminals located on a printed circuit board with a plurality of corresponding output leads carried by said connector in order to connect the terminals with other parts of the electrical system with which the printed circuit board is used, said plurality of printed terminals being arranged in a predetermined pattern comprising at least two rows of terminals oriented adjacent and parallel to a first edge of said circuit board, which connector comprises:

(a) a plurality of output leads equal in number to said plurality of printed terminals;

(b) a plurality of contacts equal in number to said plurality of printed terminals and arranged in at least two rows forming a pattern that is the mirror image of said predetermined pattern of printed terminals, each of said contacts having:

(i) a free end associated with a predetermined one of said printed terminals and electrically connected with a predetermined one of said output leads, (ii) an open position, and (iii) a closed position for contact with its associated printed terminal;

(c) a narrow hollow body formed of rigid, insulative material for housing said contacts and for carrying said output leads fixedly attached to said connector body and extending outward therefrom, said body having a median plane and two main walls parallel to said plane which are connected by two narrow walls, said walls together defining the interior of said connector body and defining an opening for receiving said printed circuit board, said circuit board when inserted by the user of the connector in said board-receiving opening being guided through a predetermined path into an operative position within the interior of said body in which position said board is disposed generally parallel to said main walls and in which each of said printed terminals of said at least two rows is in position to make contact only with its associated contact in the electrical connector, (d) resiliently deformable, elongated support means for each of said plurality of contact, each of said support means:

(i) normally supporting its respective contact in the contact's open position, and (ii) being insulated, together with its associated contact, from the other contacts and the latter's associated support means;

(e) actuator means for each of said resiliently deformable support means, each of said actuator means being positioned to deform the support means with which it is associated to urge its respective contact, in a direction generally normal to said median plane, into its said closed position;

(f) means for operating all said actuator means, said operating means having an open, inoperative position and a closed operative position, said means for operating said actuator means comprising movable carriage means positioned alongside its associated elongated support means to move longitudinally thereof and supporting at least one of said actuator means, at least one of said actuator means comprising a rigid pin formed of insulative material extending perpendicularly from said carriage means in a direction transverse to its associated elongated support means, said carriage means lying entirely outside said predetermined path followed by said printed circuit board when said board is inserted in said connector body and is moved along said path to its said operative position, said carriage operating means having a cam follower surface;

(g) manually controlled means other than said printed circuit board for urging said operating means to operate said actuator means, said urging means having an open, inoperative position and a closed, operative position, said manually controlled urging means comprising cam means movably secured to said connector body, said cam means being shaped to contact said cam follower surface and thereby urge said operating means, when said manually controlled urging means is moved from its open position to its closed position, to operate said actuator means; and (h) locking means for preventing said operation of the actuator means until after said printed circuit board with its at least two rows of terminals oriented adjacent and parallel to a first edge of said circuit board has been inserted in said board-receiving opening and, while said contacts are held by their respective support means in their normal open positions, said board has been moved along said predetermined path to its said operative position in which each of said printed terminals of said at least two rows is in position to make contact only with its associated contact of the electrical connector;

whereby all contact between said contacts and said printed terminals is avoided unless the printed circuit board has been inserted within the connector and has been moved into its said operative position.

2. The connector of claim 1 in which said movable carriage means is positioned immediately adjacent each of said elongated support means.

3. The connector of claim 1 in which said resiliently deformable support means associated with each of said contacts is an elongated member with the base portion thereof anchored to said connector body and with its other end carrying its associated contact.

4. The connector of claim 3 in which the base portions of said elongated, resiliently deformable support means associated with first and second contacts, respectively, are arranged one upon the other in a stack normal to the median plane of said connector body, with said base portions being separated from each other by electrically insulative material.

5. The connector of claim 3 in which said elongated resiliently deformable support means for each of said contacts is an electrically conductive flat spring member.

6. The connector of claim 3 in which each of said contacts in integrally formed with its respective resiliently deformable support means.

7. The connector of claim 3 in which the free ends of said elongated support means associated with the contacts in the first row of said contacts extend farther from the base portions of said support means than the free ends of the support means associated with the second row of contacts extend from the base portions of said support means.

8. The connector of claim 1 in which:

(a) said elongated, resiliently deformable support means for each of said contacts is an electrically conductive spring member, (b) a first portion of said spring member for at least one of said contacts slants diagonally with respect to the median plane of said connector body, with the end of said first slanting portion that is farther from the base portion of said spring member being closer to said median plane, and (c) said actuator pin associated with said at least one contact, when said carriage means is moved longitudinally of said spring member towards the base portion thereof after said printed circuit board is inserted in said connector body, moves longitudinally along said first slanting portion of said spring member to press the same towards said median plane and bring its associated contact into its said closed position in contact with its associated printed terminal.

9. The connector of claim 8 in which said first slanting portion of said at least one spring member is located at the free end of said member.

10. The connector of claim 1 which includes means for holding said carriage means within said connector body when no printed circuit board is inserted in said body.

11. The connector of claim 10 in which said movable carriage means for operating said actuator means defines a retaining abutment and said manually controlled cam means is positioned to contact said abutment to hold said operating means within said connector body when no printed circuit board is inserted in said body.

12. The connector of claim 8 in which a second portion of at least one of said spring members slants diagonally with respect to the median plane of said connector body, with the end of said second slanting portion that is farther from the base portion of said elongated support means being farther from said median plane, to form a V-shaped nesting arrangement with said first slanting portion to receive said actuator means and hold the carriage means on which it is supported within said connector body when no printed circuit board is inserted within said body.

13. The connector of claim 12 in which said second slanting portion of said at least one spring member is located at the free end of said member.

14. The connector of claim 1 in which said locking means for selectively preventing operation of said actuator means includes:

(a) means defining an opening in said manually controlled urging means; and (b) elongated, resiliently deformable pawl means secured at its base portion to said connector body, said pawl means being normally in positive engagement with said opening and being removable from said opening only after said printed circuit board has been inserted within said connector body and moved, while said contacts are held by their respective support means in their normal open positions, along said predetermined path all the way to its said operative position.

15. The connector of claim 14 in which (a) said means for operating said actuator means has a cam follower surface; and (b) said manually controlled urging means comprises elongated cam means rotatably attached to said connector body, said cam means having a curvilinear surface positioned to contact said means to operate said actuator means and, when it is rotated, to urge said operating means to operate said actuator means;

(c) said opening with which said pawl means is normally in positive engagement is located at the end of said elongaged cam means adjacent said pawl means; and (d) when the printed circuit board is moved into its said operative position, it disengages said pawl means form said opening in said manually controlled urging means.

16. The connector of claim 1 in which said operating means includes:

(a) means for directly operating said actuator means associated with a given row of said at least two rows of contacts; and (b) means for indirectly operating said actuator means associated with the other row of contacts, in turn, in response to the operation of said actuator means for said given row of contacts, by transmitting a mechanical force from said given actuator means through the resiliently deformable support means for the contact that is associated with said given actuator means, and from said support means to said other actuator means, whereby both said rows of contacts are moved into contact with their respective printed terminals on the printed circuit board.

17. The connector of claim 16 in which:

(a) said actuator means for said given row of contacts is located within the interior of said connector body in a position exposed to the application of translational force by said operating means; and (b) when translational force is applied as aforesaid to said actuator means for a given row of contacts, said actuator means press against their associated resiliently deformable support means:

(i) to cause said support means to be deformed and move their associated contacts in a direction generally normal to said median plane into contact with their associated printed terminals on said printed circuit board, and (ii) at the same time, through said movement of the support means for said given row of contacts to cause the contacts in said other row of contacts to move in said generally normal direction to bring them also into contact with their associated printed terminals on said board.

18. The connector of claim 17 in which:

(a) said given row of contacts is the row associated with the row of printed terminals that is most remote from said first edge of the printed circuit board; and (b) said resiliently deformable support means for said given row of contacts are:

(i) spaced farther from said median plane than are the support means for the other row of contacts, and (ii) located in a position adjacent to and overlying said last mentioned support means;

(c) actuator means for said other rows of contacts are provided between adjacent resiliently deformable support means for rows of contacts, said actuator means being formed of insulative material; and (d) when said actuating force is applied against said resiliently deformable support means for said given row of contacts, said support means:

(i) causes the contacts in said given row to move, in a direction generally normal to said median plane, into contact with their associated printed terminals on said printed circuit board, and (ii) at the same time, causes said actuator means for said other rows of contacts, in turn, to press in said generally normal direction against the resiliently deformable support means associated with said other contacts, to bring said other contacts also into contact with their associated printed terminals.

19. The connector of claim 18 in which:

(a) each of said resiliently deformable support means is elongated in shape; and (b) said actuating force is applied to said resiliently deformable support means for said given row of contacts by rigid actuating pins formed of insulative material, said pins being supported on movable carriage means and extending perpendicularly therefrom in a direction transverse to their associated elongaged support means, said carriage means:

(i) lying entirely outside said predetermined path that is followed by said printed circuit board, when it is inserted in said connector body and is moved along said path to its said operative position, and (ii) in response to said manually controlled urging means, causing said actuator means for said given row of contacts to press their associated resiliently deformable support means in a direction generally normal to said median plane to move their associated contacts into their closed positions, and at the same time to press, through said last mentioned support means, against said actuator means for the immediately adjacent one of said rows of contacts to move their associated resiliently deformable support means and the contacts supported thereby in a direction generally normal to said median plane to bring said other row of contacts into contact with their associated printed terminals, whereby all said contacts are brought into contact with their respective printed terminals on the printed circuit board only after the board has been inserted in said connector body and moved to its said operative position within said body.

20. The connector of claim 1 which includes means to hold said printed circuit board in its said operative position within the connector body after it has been placed in said position by the user of the connector, said holding means holding the printed circuit board in its said operative position automatically in response to movement of said manually controlled urging means from its open towards its closed position to urge said operating means to operate said actuator means.

21. The connector of claim 15 in which:

(a) said rotatable elongated cam means has fixedly secured thereto a rotatable stop member disposed perpendicularly to the axis of rotation of said cam means, said stop member:
(i) having an open and a closed position, and
(ii) prohibiting insertion or removal of the printed circuit board from said board-receiving opening of the connector body except when the connector is in a predetermined condition; and
(b) in said predetermined condition, said operation-preventing pawl means is positively engaged with said opening in said manually controlled urging means; and
(c) said rotatable stop member has a slot in its outer peripheral portion located at a predetermined angular position on said rotatable member, said slot being aligned, when the connector is in said predetermined condition, with said predetermined path of the printed circuit board to permit passage of the board into or out of said connector body,
whereby the printed circuit board can be inserted in or removed from said connector body only when said contacts are held by their respective support means in their normal open positions, and removal of the board will be barred by said stop member whenever said contacts have been pressed into contact with their associated printed terminals by rotation of said stop member, together with said rotatable cam means to which the stop member is fixedly secured, from said open position to said closed position of the stop member.

22. The connector of claim 21 in which:
(a) said rotatable stop member has a planar surface adjacent said board-receiving opening of the connector body;
(b) said operation-preventing pawl means is normally biased against the leading edge of said printed circuit board after the board has been inserted in the connector body and moved to its said operative position, to urge the trailing edge of the board against said planar surface of said rotatable stop member when said member has been rotated from its open position toward its closed position; and
(c) said planar surface defines a detent groove located in an angular position thereon, which angular position is different from said predetermined angular position of said slot on said stop member,
whereby the trailing edge of said printed board is held in resilient engagement, in response to the urging of said operation-preventing pawl means, with said detent groove on said planar surface after the board has been moved into the connector body through said slot in said stop member into its said operative position and said rotatable stop member has been moved from its said open position to its said closed position.

* * * * *